United States Patent [19]

Yoshiyasu et al.

[11] Patent Number: 4,521,653

[45] Date of Patent: Jun. 4, 1985

[54] CIRCUIT BREAKER WITH ARC LIGHT ABSORBER

[75] Inventors: Hajimu Yoshiyasu; Shirou Murata, both of Itami; Fumiyuki Hisatsune, Fukuyama; Shinji Yamagata, Fukuyama; Junichi Terachi, Fukuyama, all of Japan

[73] Assignee: Mitsubishi Denki Kabushiki Kaisha, Tokyo, Japan

[21] Appl. No.: 485,070

[22] Filed: Apr. 14, 1983

[30] Foreign Application Priority Data

| | | | |
|---|---|---|---|
| Apr. 15, 1982 | [JP] | Japan | 57-64380 |
| Apr. 15, 1982 | [JP] | Japan | 57-64381 |
| Apr. 15, 1982 | [JP] | Japan | 57-64382 |
| Apr. 15, 1982 | [JP] | Japan | 57-64383 |
| Apr. 15, 1982 | [JP] | Japan | 57-64388 |
| Apr. 15, 1982 | [JP] | Japan | 57-64389 |
| Jun. 15, 1982 | [JP] | Japan | 57-90605[U] |
| Oct. 22, 1982 | [JP] | Japan | 57-186306 |

[51] Int. Cl.[3] ..... H01H 33/04; H01H 9/30

[52] U.S. Cl. ..... 200/144 C; 200/144 R; 200/149 A

[58] Field of Search ..... 200/144 R, 144 C, 148 C, 200/149 A

[56] References Cited

FOREIGN PATENT DOCUMENTS

| | | | |
|---|---|---|---|
| 55-46487 | 4/1980 | Japan | 200/144 C |
| 57-45139 | 3/1982 | Japan | 200/144 C |
| 57-69605 | 4/1982 | Japan | 200/144 C |

*Primary Examiner*—Robert S. Macon

*Attorney, Agent, or Firm*—Wenderoth, Lind & Ponack

[57] ABSTRACT

The present invention relates to a circuit breaker with an arc light absorber comprising: a pair of electric contactors contained in an insulating container for opening or closing an electric circuit, electric conductors forming said electric contactors and contacts provided at said conductors, an arc extinguishing plate for extinguishing an arc produced between said contacts when said electric contactors are opened, and a pair of side walls confronting the portion except the locuses drawn by said contacts when said contactors are opened and closed at the position of the arc extinguishing plate side of said locuses to form an arc light absorber, said side walls formed of a composite material having one or more of fiber, net or porous material having more than 35% of porosity and the arc produced between said contacts being discharged through between said pair of confronting side walls.

15 Claims, 35 Drawing Figures

CIRCUIT BREAKER WITH ARC LIGHT ABSORBER

BACKGROUND OF THE INVENTION

This invention relates to a circuit breaker in which pressure in a container of the breaker is suppressed. The circuit breaker in this invention generates an arc in a container, normally a small-sized container such as a circuit breaker, a current limiter or an electromagnetic switch.

A prior art circuit breaker will be described below.

FIGS. 1A, 1B and 1C are sectional views showing a conventional circuit breaker in different operating states.

Numeral 1 designates a cover, and numeral 2 a base, which forms an insulating container 3 with the cover 2. Numeral 4 designates a stationary contactor, which has a stationary conductor 5 and a stationary contact 6 at one end of the conductor 5, and the other end of the conductor 5 becomes a terminal connected to an external conductor (not shown). Numeral 7 designates a movable contactor, which has a movable conductor 8 and a movable contact 9 disposed oppositely to the contact 6 at one end of the conductor 8. Numeral 10 designates a movable contactor unit, and numeral 11 a movable element arm, which is attached to a crossbar 12 so that each pole simultaneously opens or closes. Numeral 13 designates an arc extinguishing chamber in which arc extinguishing plates 14 are retained by side plates 15. Numeral 16 designates a toggle linkage, which has an upper link 17 and a lower link 18. The link 17 is connected at one end thereof to a cradle 19 through a shaft 20 at the other end thereof to one end of the link 18 through a shaft 21. The other end of the link 18 is connected to the arm 11 of the contactor unit 10. Numeral 22 designates a tiltable operating handle, and numeral 23 an operating spring, which is provided between the shaft 21 of the linkage 16 and the handle 22. Numerals 24 and 25 respectively designate a thermal tripping mechanism and an electromagnetic tripping mechanism, which are respectively provided to rotate a trip bar 28 counterclockwise via a bimetal 26 and a movable core 27. Numeral 29 designates a latch, which is engaged at one end thereof with the bar 28 and at the other end thereof with the cradle 19.

When the handle 22 is tilted down to the closing position in the state that the cradle 19 is engaged with the latch 29, the linkage 16 extends, so that the shaft 21 is engaged with the cradle 19, with the result that the contact 9 is brought into contact with the contact 6. This state is shown in FIG. 1A. When the handle 22 is then tilted down to the open position, the linkage 16 is bent to isolate the contact 9 from the contact 6, and the arm 11 is engaged with a cradle shaft 30. This state is shown in FIG. 1B. When an overcurrent flows in the circuit with the contacts in the closed state shown in FIG. 1A, the mechanism 24 or 25 operates, the engagement of the cradle 19 with the latch 29 is ended, the cradle 19 rotates clockwise around the shaft 30 as a center, and is abutted against a stop shaft 31. Since the connecting point of the cradle 19 and the link 17 is past the operating line of the spring 23, the linkage 16 is bent by the elastic force of the spring 23, each pole automatically cooperatively breaks the circuit via the bar 12. This state is shown in FIG. 1C.

The behavior of an arc which is generated when the circuit breaker breaks the current will be described below.

When the contact 9 is contacted with the contact 6, the electric power is supplied sequentially from a power supply side through the conductor 5, the contacts 6 and 9 and the conductor 8 to a load side. When a large current such as a shortcircuiting current flows in this circuit in this state, the contact 9 is separated from the contact 6 as described before. In this case, an arc 32 is generated between the contacts 6 and 9, and an arc voltage is produced between the contacts 6 and 9. Since this arc voltage rises as the distance from the contact 6 to the contact 9 increases and the arc 32 is urged by the magnetic force toward the plate 14 so as to be extended, the arc voltage is further raised. In this manner, an arc current approaches the current zero point, thereby extinguishing the arc to complete the breakage of the arc. The huge injected arc energy eventually becomes thermal energy, and is thus dissipated completely out of the container, but transiently raises the gas temperature in the limited space in the container and accordingly causes an abrupt increase in the gas pressure. This causes a deterioration in the insulation in the circuit breaker and an increase in the quantity of discharging spark escaping from the breaker, and it is thereby feared that an accident such as a power source shortcircuit or damage to the circuit breaker body will occur.

SUMMARY OF THE INVENTION

The present invention has overcome the disadvantages of the above-described prior art circuit breaker. More particularly, the present invention provides a novel circuit breaker with an arc light absorber based on the discovery by the present inventors of an arc phenomenon, and in which a pair of side walls forming an arc light absorber are provided corresponding to the positions of arc runners.

BRIEF DESCRIPTION OF THE DRAWINGS

In the drawings, the same symbols indicate the same or corresponding parts.

DESCRIPTION OF THE PREFERRED EMBODIMENTS

A mechanism of an arc energy consumption based on the creation of the present invention will be first described below.

Figure 1A:
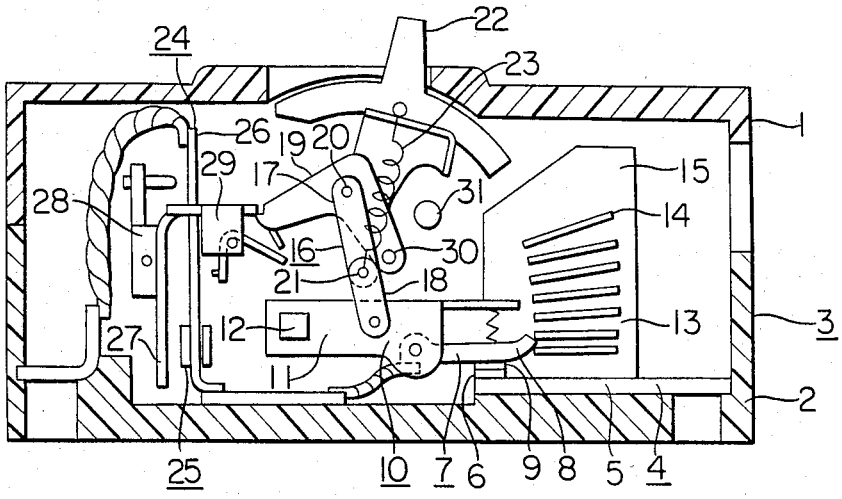
FIG. 1(A) PRIOR ART
FIG. 1A is a fragmentary sectional front view showing a prior art circuit breaker in the contact closed state.
Figure 1B:
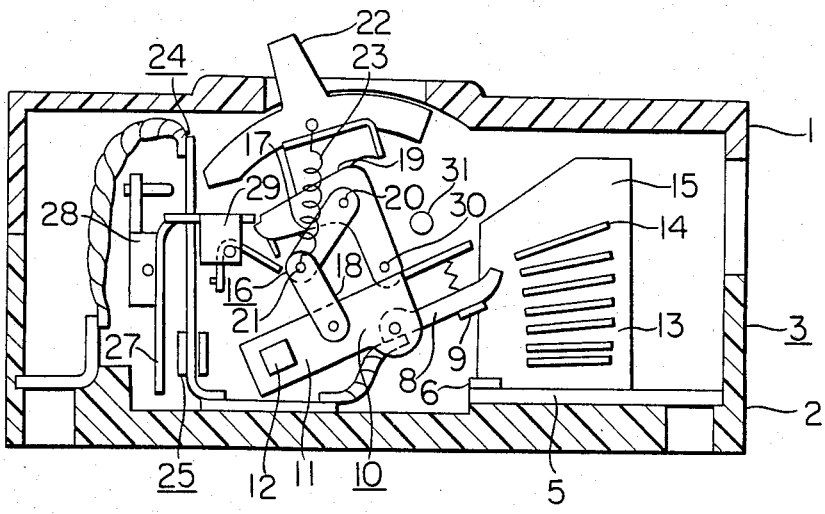
FIG. 1B is a view similar to FIG. 1A showing the contact open state with the contacts moved by the operation of an operating handle.
Figure 1C:
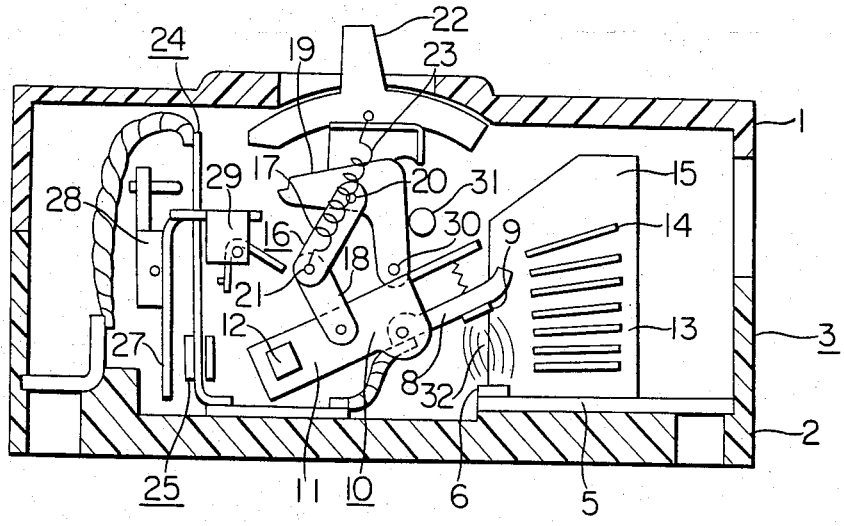
FIG. 1C is a view similar to FIG. 1B showing the contact open state at the time of overcurrent operation.
Figure 2:
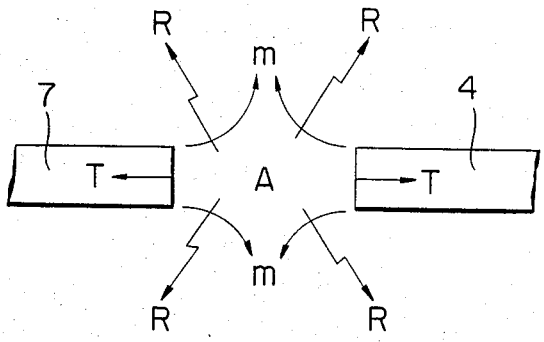
FIG. 2 is a diagrammatic view for explaining the flow of arc energy produced at the time of contactor opening.

FIG. 2 is a view showing an arc A is produced between contactors 4 and 7. In FIG. 2, character T designates a flow of thermal energy which is dissipated from the arc A through the contactors, character m the flows of the energy of metallic particles which are released from the arc space, and character R the flows of energy caused by light which is irradiated from the arc space. In FIG. 2, the energy injected to the arc A is generally consumed by the flows T, m and R of the above three energies. The thermal energy T which is conducted to electrodes is extremely small, and most of the energy is carried away by the flows m and T. In the mechanism of the consumption of the energy of the arc A, it has heretofore been considered that the flows m in FIG. 2 are almost of the energies, and the energy of the flows R has been substantially ignored, but it has been found by the recent studies of the present inventors that the consumption of the energy by the flows R and hence the energy of light is so huge as to reach approximately 70% of the energy injected into the arc A.

In other words, the consumption of the energy injected into the arc A can be formulated as below.

$$P_W = V \cdot I = P_K + Pth + P_R$$

$$P_K = \tfrac{1}{2} m V^2 + m \cdot C_p \cdot T$$

where $P_W$: instantaneous injection energy

V: arc voltage

I: current

V·I: instantaneous electric energy injected into the arc $P_K$: quantity of instantaneous energy which is carried by the metallic particles $mv^2/2$: quantity of instantaneous energy carried away when the metallic particles of mg scatter at a speed V $m \cdot C_p \cdot T$: quantity of instantaneous energy carried away when the gas (the gas of the metallic particles) of constant-pressure specific head $C_P$ pth: quantity of instantaneous energy carried away from the arc space to the contactor via thermal conduction $P_R$: quantity of instantaneous energy irradiated directly from the arc via light The above quantities vary according to the shape of the contactors and the length of the arc. When the length of the arc is 10 to 20 mm, $P_K$=10 to 20%, Pth=5%, and $P_R$=75 to 85%.

Figure 3:
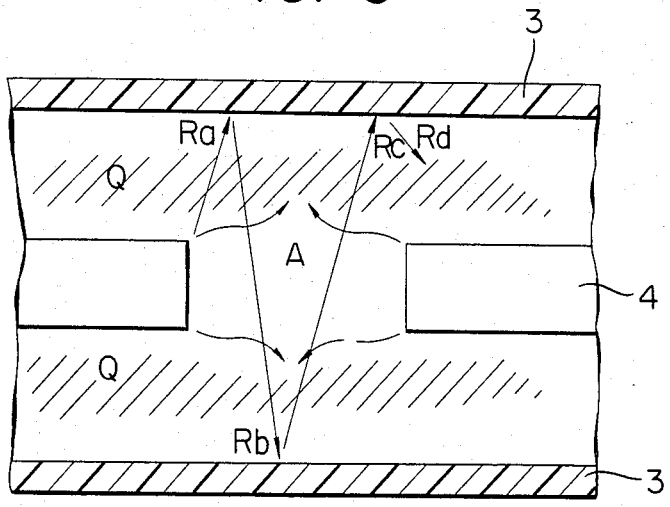
FIG. 3 is a diagrammatic view for explaining the state when the arc produced at the time of contactor opening is enclosed in a container.

The state in which the arc A is enclosed in the container is shown in FIG. 3. When the arc A is enclosed in the container 3, the space in the container 3 is filled with the metallic particles and reaches a high temperature. The above state is strong particularly in the gas space Q (the space Q designated by shading lines in FIG. 3) around the periphery of an arc positive column A. The light irradiated from the arc A is irradiated from the arc positive column A to the wall of the container 3, and is reflected from the wall. The reflected light is scattered, is passed again through the high temperature space in which the metallic particles are present, and is again irradiated to the wall surface. Such courses are repeated until the quantity of light becomes zero. One path of the light reflected in this way is shown by Ra, Rb, Rc and Rd in FIG. 3.

The consumption of the light irradiated from the arc A is at the following two points in the above course.

(1) Absorption at the wall surface (2) Absorption in the arc space and peripheral (high temperature) gas space and hence by the gas space The light irradiated from the arc includes wavelengths from far ultraviolet less than 2000 Å to far infrared more than 1 μm and a wavelength range which is continous spectra and linear spectra. The wall surface of the general container has a light absorption capability only in the range of approximately 4000 Å to 5500 Å even if the surface is black, and partly absorbs in the other range, but mostly reflects. However, the absorptions in the arc space and the peripheral high temperature gas space become as described below.

When the light of wavelength λ is irradiated to the gas space having a length of L, and uniform composition and temperature, the quantity of light absorption by the gas space can be calculated as below.

$$Ia = Ae \cdot n \cdot L \cdot Iin \quad (1)$$

where

Ia: absorption energy by gas
Ae: absorption probability
Iin: irradiated light energy
n: particle density
L: length of light path of the light However, the formula (1) represents the quantity of absorption energy for special wavelength λ. The Ae is the absorption probability for the special wavelength λ, and is a function of the wavelength λ, gas temperature and type of the particles.

In the formula (1), the absorption coefficient becomes the largest in gas of the same type as a light source gas for irradiating the same light (i.e., the type and the temperature of the particles are the same) in both the continuous spectra and the linear spectra according to the teaching of quantum mechanics. In other words, the arc space and the peripheral gas space absorb the most light irradiated from the arc space.

In the formula (1), the quantity Ia of the absorption energy of the light is proportional to the length L of the light path. As shown in FIG. 3, when the light from the arc space is reflected from the wall surface, the L in the formula (1) is increased by the number of times of reflections of the light, and the quantity of the light energy absorbed in the high temperature section of the arc space is increased.

This means that the energy of the light irradiated by the arc A is eventually absorbed by the gas in the container 3, thereby rising the gas temperature and accordingly the gas pressure.

It is the premise of the present invention that, in order to effectively absorb the energy of the light which reaches approximately 70% of the energy injected to the arc, a special material is used and one or more types of fiber, net and highly porous material having more than 35% of porosity for effectively absorbing the light irradiated from the arc are selectively disposed at a special position for receiving the energy of the light of the arc in the container of the circuit breaker, thereby absorbing a great deal of the light in the container so as to lower the temperature of the gas space and to lower the pressure.

The above-described fiber is selected from inorganic materials, metals, composite materials, woven materials and nonwoven fabric, and it is necessary that it have thermal strength since it is installed in the space which is exposed to the high temperature arc.

The above-described net includes inorganic materials, metals, composite materials, and further superposed materials in multilayers of fine metal gauze, woven strands to be selected. In the case of the net, it is also necessary to have thermal strength.

Of the above-described materials of the fiber and the net, the inorganic materials includes ceramics, carbon, asbestos, and the optimum metals include Fe, Cu, and may include plated Zn or Ni.

The highly porous material is generally a material from among metals, inorganic materials and organic materials which have a number of fine holes in a solid structure, and are classified with regard to the relationship between the material and the fine holes into material which contains as a main body solid particles sintered and solidified at the contacting points therebetween and the material which contains in a main body holes in such a manner that partition walls forming the holes are solid material. In the present invention, the term blank means the material before being machined to a concrete shape, i.e. simply "a material".

When the materials of the blanks are further more specifically classified, the material can be classified into material in which the gaps among the particles exists as fine holes, material in which the gaps among the particles commonly exist as fine holes in the particles, and material which contains foamed holes therein. The materials are generally classified into material which has air permeability and water permeability, and material which has pores individually independent from each other without air permeability.

The shape of the above fine holes is very complicated, and is generally classified into open holes and closed holes, the structures of which are expressed by the volume of the fine holes or porosity, the diameter of the fine holes and the distribution of the diameters of the fine holes and specific surface area.

The true porosity is expressed by the volume of all the open and closed holes contained in the porous material relative to the total volume (bulk volume) of the material, i.e., percentage, which is measured by a substitution method and an absorption method with liquid or gas, but can be calculated as described below as defined in the method of measuring the specific weight and the porosity of a refractory heat insulating brick of JISR 2614 (Japanese Industrial Standard, the Ceramic Industry No. 2614).

$$\text{True porosity} = (1 - \frac{\text{Bulk specific weight}}{\text{True specific weight}} \times 100\%$$

The apparent porosity is expressed by the volume of the open holes with respect to the total volume (bulk volume) of the blank, i.e., percentage, which can be calculated as described below as defined by the method of measuring the apparent porosity, absorption rate and specific weight of a refractory heat insulating brick of JISR 2205 (Japanese Industrial Standard, the Ceramic Industry No. 2205). The apparent porosity may also be defined as an effective porosity.

$$\text{Apparent porosity} = \frac{\text{Water weight} - \text{dry weight}}{\text{Water weight} - \text{underwater weight}} \times 100\%$$

The diameter of the fine holes is obtained by the measured values of the volume of the fine holes and the specific surface area, and includes several Å (Angstrom) to several mm from the size near the size of an atom or ion to the boundary gap of the particle group, which is generally defined as the mean value of the distribution. The diameter of the fine holes of the porous blank can be obtained by measuring the shape, size and distribution of the pores with a microscope, by a mercury press-fitting method. In order to accurately know the shape of the composite pores and the state of the distribution of the pores, it is generally preferable to employ a microscope as a direct method.

The measurement of the specific surface area is performed frequently by a BET method which obtains the result by utilizing adsorption isothermal lines at the respective temperatures of various adsorptive gases, and nitrogen gas is frequently used.

The patterns of the absorption of the energy of the light and the decrease of the gas pressure by the absorption with the special material according to the present invention will be described for an example of an inorganic porous material.

Figure 4:
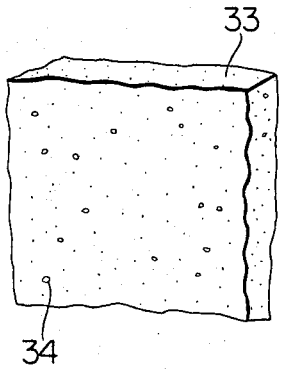
FIG. 4 is a perspective view showing an inorganic porous material for use in forming an arc light absorber.
Figure 5:
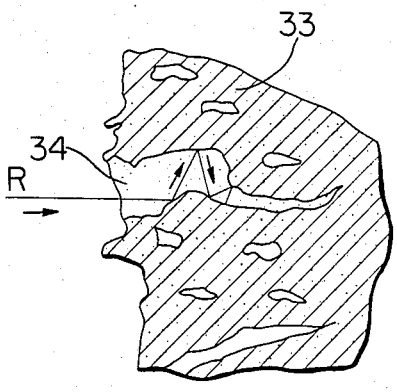
FIG. 5 is a fragmentary sectional view of an enlarged scale of a part of the material shown in FIG. 4.

FIG. 4 is a perspective view showing an inorganic porous blank, and FIG. 5 is an enlarged fragmentary sectional view of FIG. 4. In FIGS. 4 and 5, numeral 33 designates an inorganic porous blank, and numeral 34 the open holes communicating with the surface of the blank. The diameters of the hole 34 are distributed in the range from several microns to several mm in various manners.

When the light is incident to the hole 34 when the light is incident to the blank 33 as designated by R in FIG. 5, the light is irradiated onto the wall surface of the blank, is then reflected from the wall surface, is reflected in multiple ways in the hole, and is eventually absorbed 100% by the wall surface. In other words, the light incident to the hole 34 is absorbed directly in the surface of the blank, and becomes heat in the hole.

Figure 6:
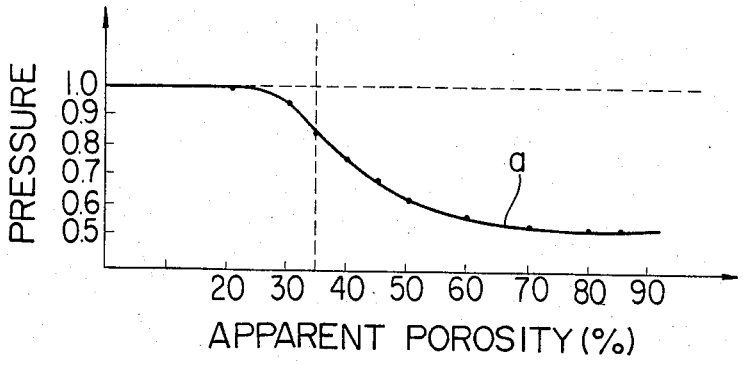
FIG. 6 is a characteristic curve diagram for showing the relationship between the apparent porosity of the inorganic porous material and the pressure in the container for containing the material.

FIG. 6 shows a characteristic curve diagram of the variation in the pressure in the model container in which the inorganic porous material is placed when the apparent porosity of the material is varied. In FIG. 6, the abscissa is the apparent porosity, and the ordinate expresses the pressure relative to a pressure of 1 as a reference when the porosity is 0 when the inner wall of the container is formed of metal such as Cu, Fe or Al. In the experiment AgW contacts were installed at a predetermined gap of 10 mm in a sealed cubic container with a side edge of 10 cm, an arc from a sinusoidal current of 10 kA at the peak was produced for 8 msec, and the pressure in the container produced by the energy of the arc was measured.

The inorganic porous materials used in the above embodiment were pieces of porous porcelain 50 mm×50 mm×4 mm prepared by forming and sintering a raw material of porcelain of cordierite to which was added an inflammable or foaming agent to form the porous material, which had fine holes with a mean diameter in the range of 10 to 300 microns and respective apparent porosities of 20, 30, 35, 40, 45, 50, 60, 70, 80 and 85%. These pieces were disposed on the wall surface of the container to cover 50% of the surface area of the inner surface of the container.

With respect to the diameter of the fine holes, a mean diameter which slightly exceeds the range of the wavelengths of the light to be absorbed and the rate of the fine holes occupying the surface, i.e., the degree of the specific surface area of the fine holes, become important. In the absorption of the light in the fine holes, the deep holes are more effective, and communicating pores are preferable. Since the light irradiated by the arc A has wavelengths distributed in the range of several hundreds Å to 10000 Å (1 μm), fine holes of several thousands Å to several 1000 μm mean diameter, which slightly exceeds the above wavelengths, are adequate, and a highly porous material has an apparent porosity which exceeds 35% in the area of the holes occupying the surface is useful for absorbing the light irradiated from the arc A. The effect can be particularly improved when the upper limit of the diameter of the fine holes is in the range less than 1000 μm and the specific surface area of the fine holes is larger. According to the experiments, it is confirmed that preferred absorbing characteristic can be obtained for the light irradiated from the arc by a material having a range of mean diameters of the fine holes from 5 μm to 1 mm. It is also observed that a glass material having 5 or 20 μm holes absorbs the light irradiated from the arc A very well.

As seen from the characteristic curve a in FIG. 6, the pores of the inorganic porous material absorb the light energy, and act to lower the pressure in the circuit breaker, which effect increases as the apparent porosity of the porous blank is increased, and increases remarkably as the porosity becomes larger than 35%, and which increases in the range up to 85%. When the porosity is further increased, it is necessary to further increase the thickness of the porous material.

When the porosity is increased, the relationship between the apparent porosity and the mechanical strength of the porous blank becomes such that the material becomes brittle, the thermal conductivity of the material decreases, and the material becomes readily fusible by the high heat. When the porosity is decreased, the effect of reducing the pressure in the circuit breaker is reduced. Accordingly, the optimum apparent porosity of the porous blank in practical use is in the range of 40 to 70%.

The characteristic trend of FIG. 6 can also be applied to the general inorganic porous materials, and this can be assumed from the above description as to the absorption of the light.

Some prior art circuit breakers use inorganic material, but its object is mainly to protect the organic material container against the arc A, and the necessary characteristics include arc resistance, lifetime, thermal conduction, mechanical strength, insulation and carbonization resistance. An inorganic material which satisfied these characteristics is composed of a material which has a tendency toward low porosity, and the object is different from the object of the present invention, and the apparent porosity of the prior art material is approximately 20%.

The highly porous materials are inorganic, metallic and organic materials, and the inorganic materials are particularly characterized as insulating and the high melting point material. These two characteristics are needed for the material to be installed in the container of the circuit breaker. In other words, since the material is electrically insulating, which does not have an adverse influence on the breakage, and since the material has a high melting point, the material does not become molten nor produce gas, even if the material is exposed to high temperature, and the material is optimum as the pressure suppressing material.

The inorganic porous materials can be porous porcelain, refractory material, glass, and cured cement, all of which can be used to decrease the gas pressure in the circuit breaker. The porous materials of the organic type have problems with respect to the heat resistance and gas production, the porous materials of the metal type have problems with respect to the insulation and pressure resistance, and are respectively limited in the places where they can be used.

In the circuit breaker in which arc runners are respectively provided on the conductors 5 and 8, an arc produced at the contacts upon opening of the contacts is transferred to the arc runners, and hence the end sides of the arc runners via magnetic force and the arc is elongated. Since this arc has huge energy, the arc raises the temperature of the gas in the container, thereby widely dissociating the ionizing the gas and accelerating the increase in the gas becoming conductive in the container. As a result, the arc is transferred to the arc runners, is elongated, and a becomes higher voltage arc. Since this high voltage arc tends to have a lower stable voltage and the gas becoming conductive at high temperature fills the container, the arc reversely returns to the contacts, thereby decreasing the arc voltage. This greatly reduces the breaking performance of the circuit breaker.

The present invention contemplates to eliminate the above-described problems of the prior art circuit breaker.

Embodiments of the present invention will now be described with reference to the accompanying drawings.

Figure 7A:
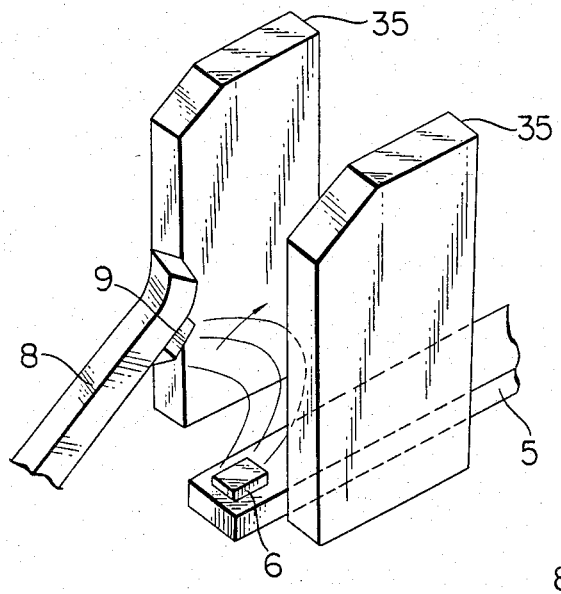
FIG. 7A is a perspective view showing an essential portion of a circuit breaker according to one embodiment of the present invention.
Figure 7B:
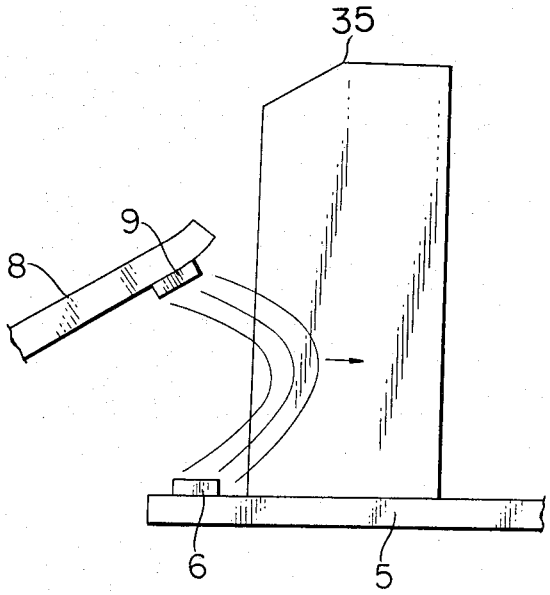
FIG. 7B is a side view of the structure of FIG. 7A.
Figure 7C:
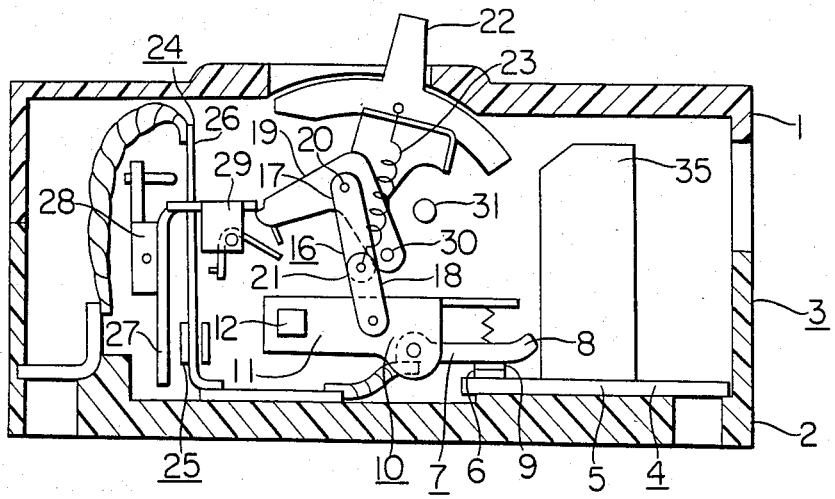
FIG. 7C is a fragmentary sectional front view of the circuit breaker including the structure shown in FIG. 7A.

FIG. 7A is a perspective viewing showing the essential portion of an embodiment of the circuit breaker according to the present invention, FIG. 7B is a side sectional view of FIG. 7A, and FIG. 7C is a side sectional view showing the entire circuit breaker. In FIGS. 7A to 7C, numeral 5 designates a stationary conductor, numeral 6 a stationary contact, numeral 8 a movable conductor, numeral 9 a movable contact, numeral 32 an arc, and numerals 35 side walls forming an arc light absorber, the material of which is an inorganic porous material or organic and inorganic composite material having more than 35% apparent porosity. The side walls are in spaced opposed relationship on opposite sides of the arc 32 produced between the contacts 6 and 9, the side walls being spaced away from the contacts and conductors in the direction in which the arc expands just beyond the locuses of movement of the conductor 8 and the contact 9.

The remaining structure of FIG. 7C is similar to the prior art circuit breaker described above, so the detailed description thereof will be omitted. The operation of the circuit breaker of the invention will now be described. The arc is produced between the contacts 6 and 9 is similar to the prior art, but since the side walls 35 are provided spaced away from the point at which the arc 32 is produced, the following advantages are obtained. Since the side walls 35 operate to absorb the energy of the light and to decrease the pressure as described above, the pressure in the space between the side walls 35 which is spaced from the arc producing point is substantially reduced, so that a force for attracting the arc 32 in a direction toward the space between the side walls 35 (arrow directed to the right) is generated, the arc 32 is thus expanded quickly toward the space between the side walls 35, the arc voltage is raised, and the current limiting effect is produced.

Since the pressure suppression in the cover 1 and the base 2 is effectively performed, the following effects are produced:

(1) Since the damage to a molded case at the time of current interruption which tends to occur in the prior art circuit breaker is prevented, the quantity material used in molding the cover 1 and the base 2 can be reduced. Instead of reducing the quantity of the material, more inexpensive molding material having low mechanical strength can be used.

(2) Since the increase in the internal pressure at the time of current interruption is reduced, the quantity of the arc discharging spark is reduced, and a secondary fire accident due to shortcircuit of the power supply inside and outside the molded case, which tends to occur at the time of current interruption, particularly for a large current, can be eliminated.

(3) Since the temperature rise of the arc is reduced by the suppression of the increase in internal pressure and the arc 32 is directed between the side walls 35, the decreases in the resistance between the metal in the vicinity of the arc 32 and the current caused by the melting and evaporating of the insulator and the resistance between the current phases can be prevented.

(4) Since no light absorber is provided beside the locuses of movement of the contact 9 and the conductor 8, the contact 9 and the conductor 8 do not contact the side walls 35 due to lateral fluctuation which may occur during the operation of the conductor 8, thereby eliminating the possibility of removal of powder from the side walls 35 and the production of cracks in the side walls 35. The resistance between the contacts 6 and 9 after the current interruption is improved.

(5) Since the surfaces of the side walls 35 are not vitrified but are crystallized due to the direction irradiation from the arc 32, when inorganic porous material which mainly contains magnesia or zirconia is used as the porous material of the side walls 35, the resistance of the surface is not lowered during the time of the existence of the arc. Accordingly, good current interrupting performance can be obtained.

(6) When the surface of the porous material of the side walls 35 is heat treated and organic material is suitably mixed with the inorganic porous material, the loss of fine powder from the wide walls 35 due to the vibration and impact of the circuit breaker can be prevented.

Thus a high performance, safe and reliable circuit breaker is provided in an inexpensive way.

The relationship between the arc extinguishing plates and the arc will be described.

An arc extinguishing plate generally operates to cool the arc by the magnetic force at the time of current interruption by attracting and driving the arc to contact the arc with the arc extinguishing plate. Thus, the arc is attracted to the arc extinguishing plate, is moved to the vicinity of the plate, and is kept in the space. In this case, the position of the arc attracted toward the arc extinguishing plate and kept in position varies largely according to the shape of the plate and the current value of the arc. The reason for the variation in the position of the arc is because of the magnetic force, and relates to differences in the behavior of the arc as shown in FIGS. 8A and 8B.

Figure 8A:
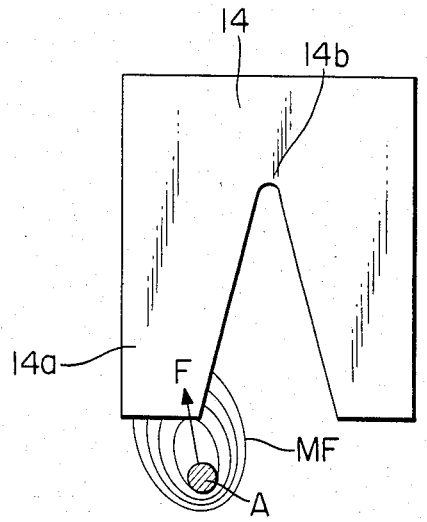
FIGS. 8A and 8B are plan views of the arc extinguishing plate for explaining the behavior of an arc.
Figure 8B:
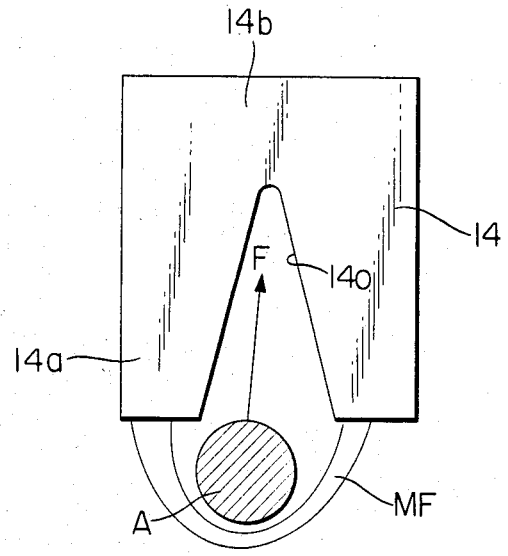

In other words, one way the arc behaves is as shown in FIG. 8A, in which the arc is small and the magnetic field MF affecting the arc A is spatially locally confined as compared with the geometrical dimensions of the arc extinguishing plate 14, and the arc A is attracted by the magnetism only from the front end 14*a* of the plate 14. The other way the arc behaves is as shown in FIG. 8B, in which the arc A is large, and the arc A is attracted toward the rear end 14*b* of the plate through the notch 14*a* upon receiving a force in the direction of an arrow F by the magnetic field produced by the entire plate 14. The above phenomena depend upon the two factors, i.e., the size of the arc extinguishing plate and the magnitude of the arc current.

Figure 9A:
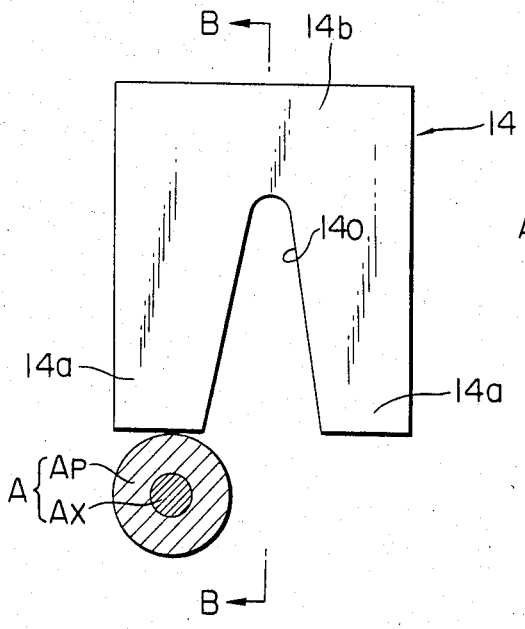
FIGS. 9A and 9B are plan and front sectional views, respectively, of the arc extinguishing plates for similarly explaining the behavior of the arc.
Figure 9B:
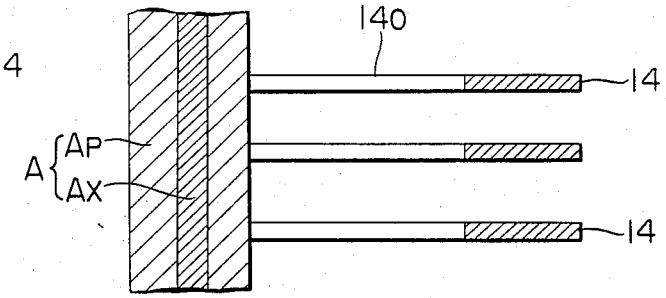

The situation in which the arc A is attracted to the front end 14*a* of the plate 14 will be described with reference to FIGS. 9A and 9B.

It is generally understood that the temperature of the center of the positive column in the arc is higher than 20000° C., the temperature of the periphery of the arc is approx. 8000° C. and the quantity of the light energy from the center is remarkably large. The arc A is attracted to the front end 14*a* of the plate 14, but the center of existing arc A is disposed at a position slightly spaced from the plate 14. When the outer periphery Ap of the arc A contacts the plate 14, the arc is cooled by the contacted plate 14, and the center Ax of the positive column cannot approach the plate 14 any further. Accordingly, the center Ax of the positive column is held at a position slightly spaced from the plate 14. This can be shown directly or indirectly by photographing with a high speed camera or the observation of the damage to the wall surface of the container after breakage.

Figure 10A:
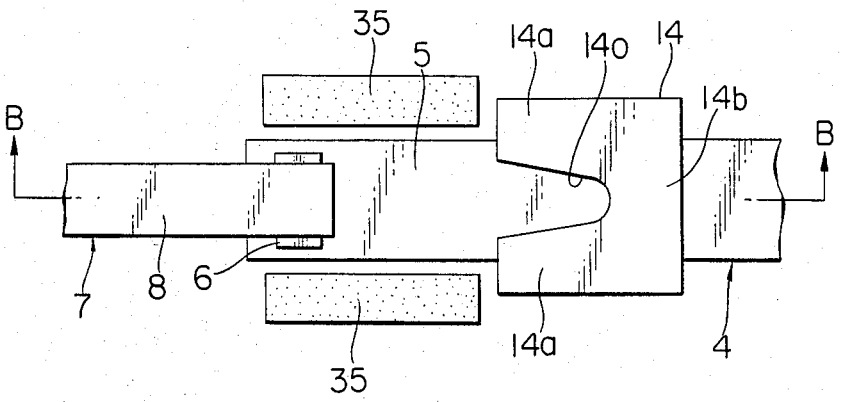
FIG. 10A is a plan view showing the essential portion of the circuit breaker according to another embodiment of the present invention.
Figure 10B:
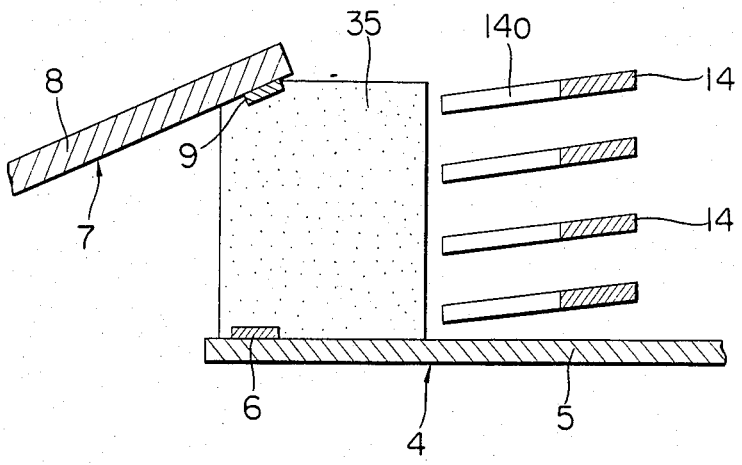
FIG. 10B is a fragmentary sectional front view of the portion of FIG. 10A.

FIGS. 10A and 10B show an arc extinguishing plate and the parts in the vicinity of the plate in a circuit breaker according to another embodiment of the present invention. In FIGS. 10A and 10B, side walls 35 are provided at the front positions of both the sides 14*a* of an arc extinguishing plate 14, and more particularly between the plate 14 and the contacts 6, 9, and the walls 35 are an inorganic porous material having more than 35% apparent porosity as described above. The side walls 35 are fixed in position with refractory adhesive.

In the structure, as thus constructed, the plate 14 is contacted by the outer periphery Ax of the arc A as described above, and when the center Ax of the arc positive column is stopped before it reaches the plate 14, the large quantity of energy R irradiated from the center Ax can be effectively absorbed by the side walls 35.

Figure 11A:
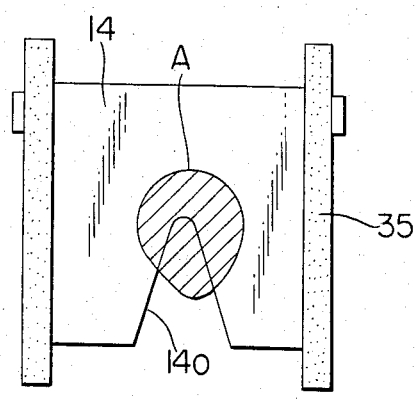
FIG. 11A is a plan view showing the arc extinguishing plate and the side walls of the circuit breaker according to another embodiment of the present invention.
Figure 11C:
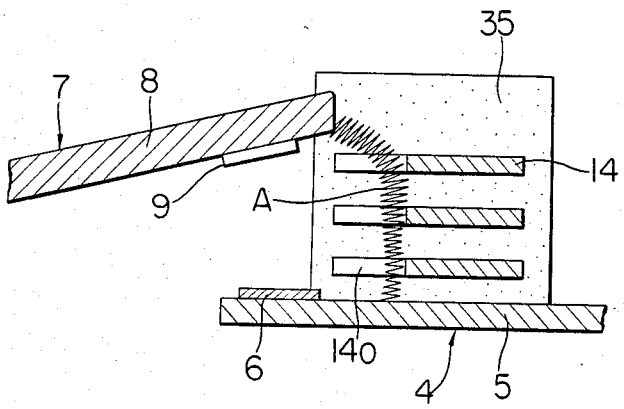
FIG. 11C is a fragmentary sectional front view of the vicinity of the contact section of the circuit breaker of FIG. 11A.
Figure 11B:
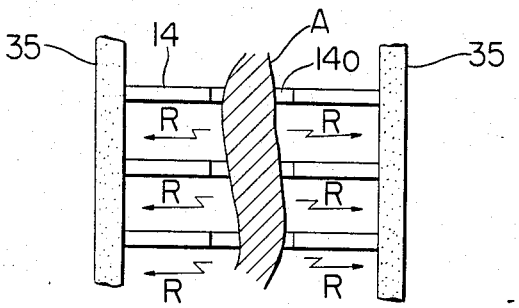
FIG. 11B is a side view of FIG. 11A.
Figure 11D:
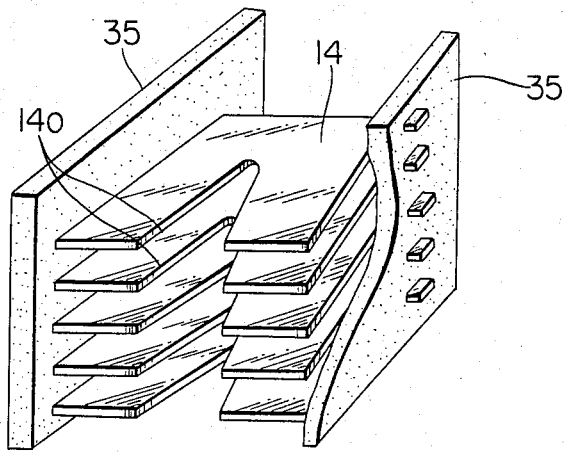
FIG. 11D is a perspective view of the structure of FIG. 11A.

FIGS. 11A to 11D show another example of the use of side walls 35 which are formed of the above-described inorganic porous material. As shown in FIG. 11A, the arc A is generally attracted to the arc extinguishing plates 14, and is cooled when it comes in contact with the plates 14. At this time, since the light energy R from the arc A is irradiated as shown in FIG. 11B, the side plates 35 which are disposed on the sides of the plates 14 and which are formed of an arc light absorber material, i.e., inorganic porous material, effectively absorb the light energy R. FIG. 11D is a perspective view of FIG. 11A, and FIG. 11C is a side view for showing the movement of the arc. In FIG. 11C, when the electric contactors 4 and 7 are opened, an arc A is produced between the contacts 6 and 9, and when the distance between the contacts 6 and 9 is lengthened and the attracting action of the plates 14 becomes effective, the arc A is driven toward the plates 14 and is contacted with the plates 14. Generally, the larger the interrupted current, the quicker the distance between the contacts 6 and 9 becomes large, and the larger the attracting force of the plates 14. Accordingly, the larger the curent, the more rapidly the arc A is isolated from the contacts 6 and 9, is contacted with the plates 14, and is kept in the plate 14. The time the arc A stays during the arc producing period is sufficiently large. Consequently, when the side walls 35 of inorganic porous material are positioned at a point nearest to the arc, i.e. along the sides of the plates 14, the light energy R from the arc A can be absorbed to a large degree, thereby effectively reducing the internal pressure in the circuit breaker.

Figure 12A:
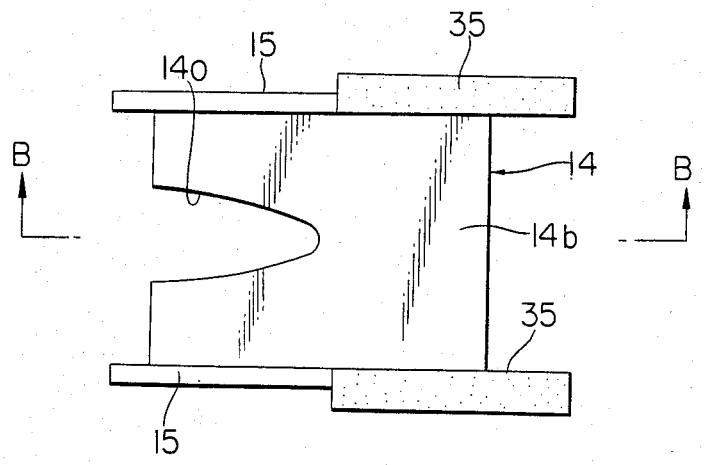
FIGS. 12A, 13A and 14A are plan views of the vicinity of the arc extinguishing plate of the circuit breaker according to still another embodiment of the present invention.
Figure 12B:
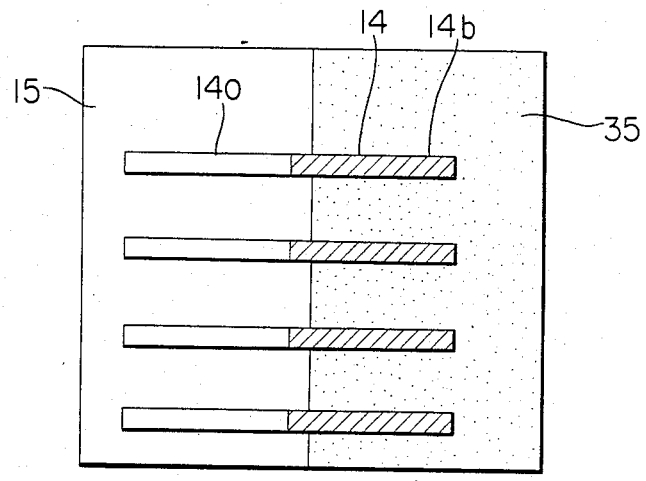
FIGS. 12B, 13B and 14B are fragmentary sectional front views on lines B—B of FIGS. 12A, 13A and 14A, respectively.
Figure 13A:
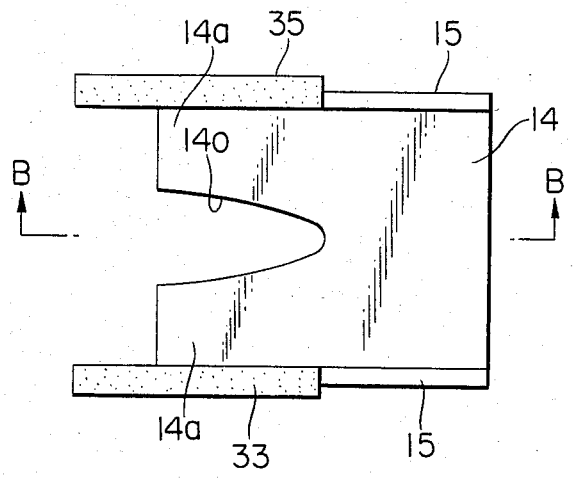
Figure 13B:
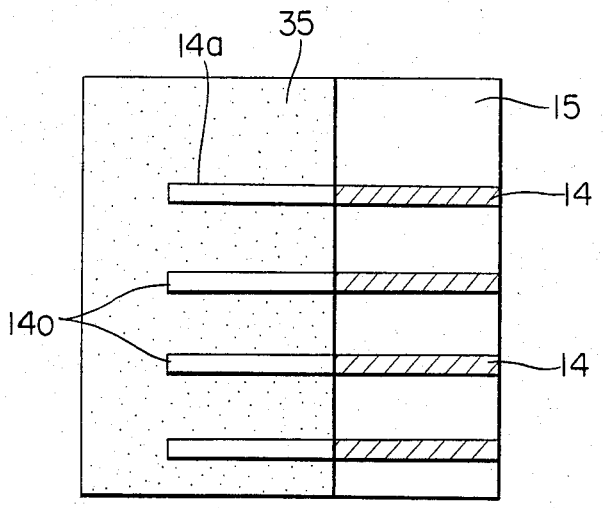

In order that the side walls 35 provided on the sides of the arc extinguishing plates 14 are at the optimum positions for absorbing the light energy as described above, the position of the side walls 35 is selected according to the internal structure of the circuit breaker. FIGS. 12A and 12B show still another example in which side plates 15 are along the sides of the arc extinguishing plates toward the front thereof, and side walls 35 are along sides of the arc extinguishing plates 14 at the rear thereof, and FIGS. 13A and 13B show still another example in which side plates 15 and side walls 35 are at the rear and the front, respectively, of the arc extinguishing plates 14.

Figure 14A:
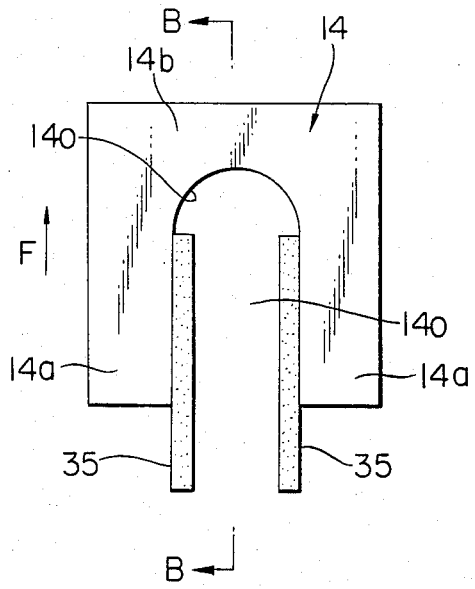
Figure 14B:
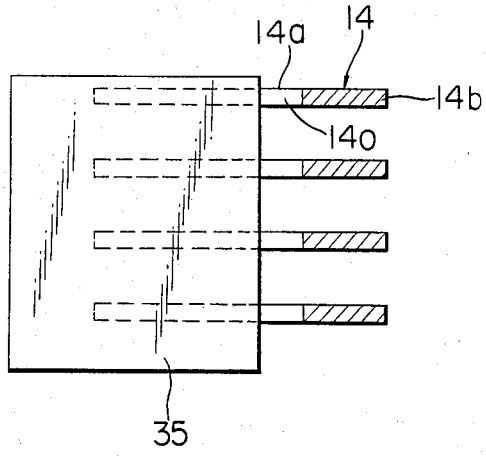
Figure 15:
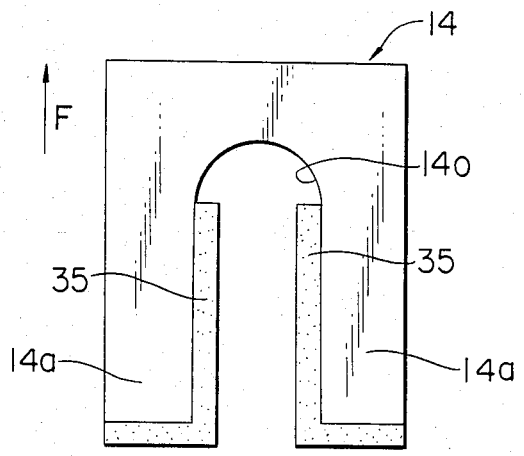
FIG. 15 is a plan view of the arc extinguishing plate of still another embodiment of the structure of FIG. 14A.
Figure 16A:
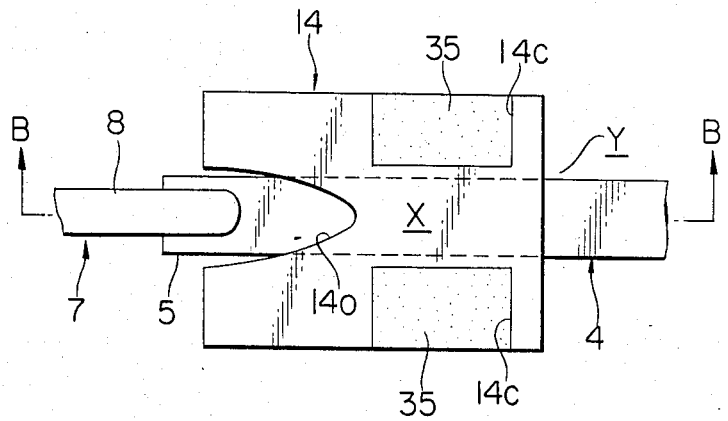
FIG. 16A is a plan view of the vicinity of the arc extinguishing plate of a circuit breaker according to still another embodiment of the present invention.
Figure 16B:
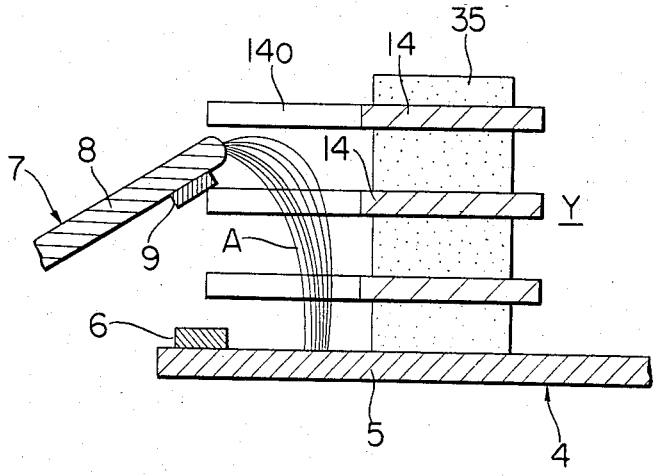
FIG. 16B is a fragmentary sectional front view of the circuit breaker of FIG. 16A.

FIGS. 14A and 14B show still another example in which the side walls 35 are provided on opposite sides of the notches of extinguishing plates 14, and FIG. 15 shows still another example in which the side walls 35 extend around the front ends of the arc extinguishing plates 14. In these cases, the arc light energy can be effectively absorbed. Further, FIGS. 16A and 16B show still another example in which side walls 35 are engaged in notches 14C formed in the side edges of arc extinguishing plates 14. In this case, the arc A produced between the contacts 6 and 9 and attracted by the arc extinguishing plates 14 strikes on plates 14, is divided by the plates 14, and is moved in the direction away from the contacts 6 and 9. At this time, a relatively small current will pass through the space X between the side walls 35 which are formed of the above-described inorganic porous material. On the other hand, when a large current passes through space X, and becomes narrow as it moves through the space X, the pressure in the space increases, with the result that the current can hardly pass through the space X. The light energy is effectively absorbed by the side walls 35, and the high temperature gas passing through the space X is cooled to a low temperature. Consequently, the temperature of the gas in the space Y at the rear of the plates 14 becomes relatively low as compared with the other positions in the circuit breaker. In other words, since the light energy is absorbed by the side walls 35 and the electric conductivity is lowered, no arc A is produced at the rear end 14*b* of the plates 14 as in the conventional circuit breaker.

Since the energy in the circuit breaker does not increase the gas temperature but is absorbed directly in the form of the light by the side walls 35, the internal pressure in the circuit breaker is reduced, thereby remarkably reducing the discharging spark.

Figure 17A:
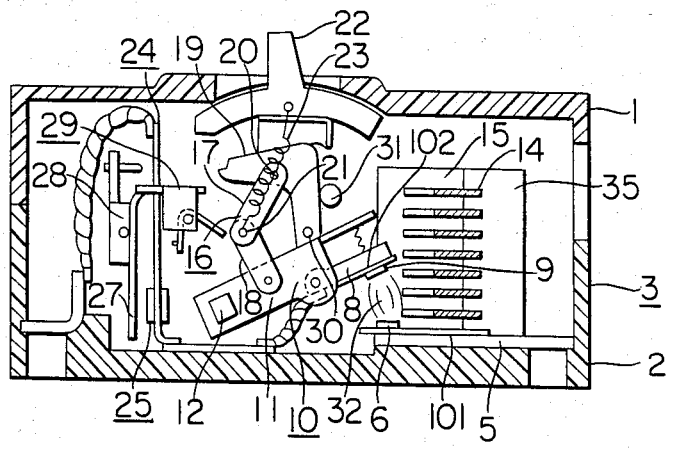
FIG. 17A is a fragmentary sectional front view of a circuit breaker according to still another embodiment of the present invention.
Figure 17B:
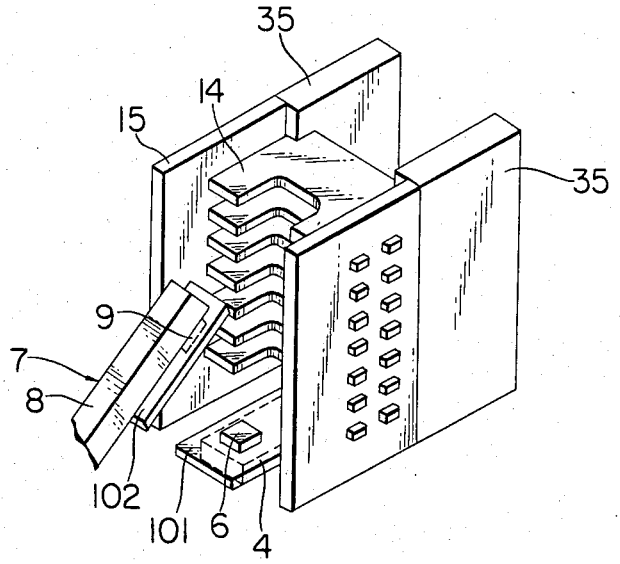
FIG. 17B is a perspective view of the vicinity of the arc extinguishing plate of the circuit breaker of FIG. 17A.
Figure 17C:
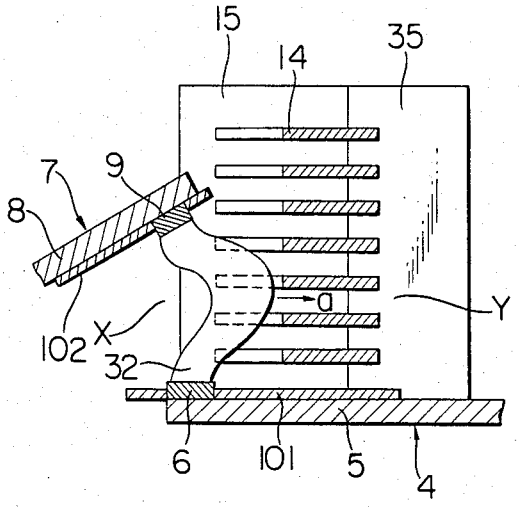
FIG. 17C is a fragmentary sectional front view of the structure of FIG. 17B.
Figure 18:
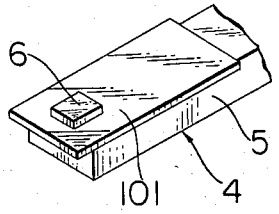
FIG. 18 is a perspective view of an arc shield used in the embodiment of FIG. 17A.

FIGS. 17A, 17B and 17C show still another embodiment in which an arc shield surrounding around the contacts is provided on the conductors of an electric contactor as shown in FIG. 18. This shield is shown as applied to the embodiment shown in FIGS. 12A and 12B, but may be applied to other examples. More particularly, in FIGS. 17A, 17B and, 17C and 18, numerals 101 and 102 designate arc shields which are formed of an organic insulating material such as known synthetic resin and are respectively formed on the stationary conductor 5 and a movable conductor 8 and surround the outer peripheries of the stationary contact 6 and the movable contact 9. The shields 101 and 102 are readily formed by coating the conductors 5 and 8 by painting or by fixing plates formed of the above-described synthetic resin to the conductors 5 and 8. In this case, the shields 101 and 102 are not only simply formed, but are formed inexpensively, and since the increase in the weight can be of the contactor 7 is minimized, the inertial moments of the shields can be reduced, thereby increasing the isolating speed of the contactor 7 and accordingly enhancing the arc voltage.

Side walls 35 which are formed of a light absorber are provided as shown in FIG. 17B on both sides of the arc space in the arc moving direction (the direction of the arrow a in FIG. 17C) from the locuses of the contacts 6 and 9. The side walls 35 are formed of a composite material which has one or more of the above-described special materials thereon such as, fiber, net and porous material and having more than 35% apparent porosity.

The operation of this embodiment will be described.

The arc 32 is produced between the contacts 6 and 9 in the same manner as in the prior art circuit breaker, but since the arc shields 101 and 102 are provided around the outer peripheries of the contacts 6 and 9, the arc 32 is throttled to a narrow space. Consequently, the sectional area of the arc 32 is extremely limited as compared with the prior art circuit breaker which does not have the shields 101 and 102, and the arc voltage is accordingly raised greatly, thereby improving the current limiting performance. Another feature of this embodiment is that the arc shields 101 and 102 are formed of an organic insulator and arc absorbing side walls 35 which are formed of the above special material such as a porous material having more than 35% porosity are mounted at a position spaced in the arc moving direction from the contacts 6 and 9. In other words, the heat resistance of the organic insulating material is not so high, and it is consumed in large amounts by the heat of the arc 32, thereby discharging large quantity of evaporated particles therearound. Therefore, as shown in FIG. 17C, the gas pressure is increased greatly in the space X in the vicinity of the arc 32. On the other hand, since the side walls 35 are provided at a position spaced from the contacts 6 and 9, the light of the arc 32 is absorbed by the side walls 35, and the gas pressure in the space Y will hardly increase. Consequently, the pressure difference between the spaces X and Y becomes very large, thereby producing a gas flow. In other words, the arc 32 is rapidly moved in the direction of the arrow a due to the above pressure difference, thereby elongating the arc length. Therefore, the arc 32 is further readily contacted with the arc extinguishing plates 14, and the arc voltage is further raised, thereby greatly improving the current limiting performance and the current interrupting performance of the circuit breaker.

Figure 19:
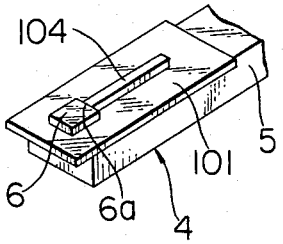
FIG. 19 is a perspective view showing another arc shield.

FIG. 19 shows a modified example of the stationary electric contactor 4 providing an arc shield 101. An arc moving path 104 which is formed of a groove extending in a direction for isolating the contact 6 from the end 6*a* of a stationary contact 6 such as in the arc moving direction, i.e., toward the arc extinguishing plates 14, is formed in the arc shield 101.

In this manner, the foot of the arc 32 moves along the arc moving path 014, and the arc 32 can further readily move toward the plates 14. Thus, the arc 32 is readily contacted with the plates 14, thereby improving the current interrupting performance in the small current range.

When the side walls 35 employ an inorganic porous material which mainly contains magnesia or zirconia, the side walls 35 are not vitrified but are crystallized. Accordingly, the insulating resistance of the surfaces of the side walls 35 is not lowered during the arc generating period, thereby obtaining good current interrupting performance. When the surfaces of the side walls 35 are heat treated and an organic material is suitably mixed with the inorganic porous material, the shedding of powder from the side walls 35 due to the vibration and impact of the circuit breaker can be effectively prevented without disturbing the operation of lowering the internal pressure in the circuit breaker.

What is claimed is:

1. A circuit breaker with an arc light absorber comprising:

a pair of electric contactors contained in an insulating container for opening or closing an electric circuit;

electric conductors extending to said electric contactors and contacts on said conductors; and a pair of side walls in spaced opposed relation to each other and spaced from each other in a direction transverse to said contactors and spaced from said contactors in the direction in which the arc produced between said contacts when said contactors are opened expands from said contactors and defining a space between them to receive the expanding arc, said side walls having a size for absorbing light from the arc;

said side walls being formed of a heat resistant, electrically insulating, light absorbing material having more than 35% apparent porosity.

2. A circuit breaker as claimed in claim 1 further comprising at least one arc extinguishing plate for extinguishing the arc, said arc extinguishing plate being spaced from said contactors in the direction in which said arc expands from said contactors.

3. A circuit breaker as claimed in claim 2 wherein said side walls are provided at the portion of the edges of said arc extinguishing plate which are closest to said contactors.

4. A circuit breaker as claimed in claim 2 wherein said side walls are engaged with the side edges of said arc extinguishing plate.

5. A circuit breaker as claimed in claim 2 wherein said arc extinguishing plate has a notch in the end toward said contactors, and said side walls are along the edges of said notch.

6. A circuit breaker as claimed in claim 5 wherein said side walls have portions extending along the portions of the edge of said arc extinguishing plate which is toward said conductors which portions lie on opposite sides of said notch.

7. A circuit breaker according to claim 2 wherein said arc extinguishing plate has further notches in both side edges and said side walls are respectively engaged in said notches.

8. A circuit breaker according to claim 1 further comprising arc shields surrounding said contacts and fixed to said conductors, said shields being made of a high resistance material having a resistivity higher than said electric conductors.

9. A circuit breaker according to claim 8 wherein said arc shields have grooves therein constituting paths for moving the arc.

10. A circuit breaker according to claim 1 wherein the surfaces of said side walls are heat treatment hardened.

11. A circuit breaker according to claim 1 wherein said material comprises magnesia.

12. A circuit breaker according to claim 1 wherein said material comprises zirconia.

13. A circuit breaker according to claim 1 wherein said material is an inorganic porous material having an apparent porosity of 40 to 70%.

14. A circuit breaker as claimed in claim 13 wherein said inorganic porous material is selected from the group consisting of porous porcelain, refractory material, glass and cured cement.

15. A circuit breaker according to claim 13 wherein said inorganic porous material has fine holes therein having a mean diameter of several thousand Å to several thousand μm.

* * * * *